US007360782B2

(12) United States Patent
Gignoux

(10) Patent No.: US 7,360,782 B2
(45) Date of Patent: Apr. 22, 2008

(54) CROSSCOUNTRY SKI

(75) Inventor: Pierre Gignoux, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 266 days.

(21) Appl. No.: 11/044,213

(22) Filed: Jan. 28, 2005

(65) Prior Publication Data

US 2005/0206128 A1 Sep. 22, 2005

(30) Foreign Application Priority Data

Feb. 10, 2004 (FR) ..... 04 50232

(51) Int. Cl.

| | |
|---|---|
| ***A63C 5/00*** | (2006.01) |
| ***A63C 5/07*** | (2006.01) |
| ***A63C 5/04*** | (2006.01) |
| ***A63C 9/00*** | (2006.01) |
| ***A63C 1/24*** | (2006.01) |
| ***B62B 17/00*** | (2006.01) |

(52) U.S. Cl. ..... 280/602; 280/607; 280/601; 280/609; 280/610; 280/11.14; 280/14.22; 280/14.23; 280/616

(58) Field of Classification Search ..... 280/602, 280/607, 601, 609, 610, 11.14, 14.22, 14.23, 280/616

See application file for complete search history.

(56) References Cited

U.S. PATENT DOCUMENTS

| | | | | |
|---|---|---|---|---|
| 3,300,226 | A * | 1/1967 | Reed, Jr. | 280/602 |
| 4,221,400 | A * | 9/1980 | Powers | 280/602 |
| 5,301,976 | A * | 4/1994 | Stepanek et al. | 280/602 |
| 5,326,126 | A * | 7/1994 | Ruffinengo | 280/602 |
| 5,470,094 | A * | 11/1995 | Commier et al. | 280/602 |
| 6,530,852 | B2 * | 3/2003 | Rios | 473/566 |
| 7,134,680 | B2 * | 11/2006 | Emig et al. | 280/602 |

FOREIGN PATENT DOCUMENTS

| | | | |
|---|---|---|---|
| CH | 554 178 | A | 9/1974 |
| DE | 10204330 | A1 * | 8/2003 |
| FR | 1 470 094 | A | 2/1967 |

* cited by examiner

*Primary Examiner*—Christopher P. Ellis
*Assistant Examiner*—John R. Olszewski
(74) *Attorney, Agent, or Firm*—Browdy & Neimark, P.L.L.C.

(57) ABSTRACT

A crosscountry ski (1), the lower face (3) of which is curved to form a wax zone (2) positioned substantially in the region lying below the user's boot, wherein its upper face (11) has at least one recess (10), and wherein each recess (10) holds a rigid longitudinal bar (12, 13) extending from the rear of the wax zone (2) to the front of said zone, with one of the ends (17) of each bar (12, 13) abutting (4) on an element (16) which is fixed relative to the ski, while complementary means (20) interacting with the other end (18) of each bar (12, 13) are provided in order to adjustably compress said bar (12, 13).

20 Claims, 4 Drawing Sheets

CROSSCOUNTRY SKI

TECHNICAL FIELD

The invention relates to the field of gliding sports, and more precisely to that of crosscountry skiing. It more particularly concerns a novel board architecture intended to make the stiffness of the board adjustable for the user. It therefore allows the ski to be adapted to different body shapes, and to different skiing styles.

Prior Art

In general, a crosscountry ski is designed on the one hand in order to optimize the thrust exerted by the skier and, on the other hand, to provide a gliding phase which is as long as possible between the thrust phases. This is why the bottom surface of a crosscountry ski is strongly curved and has a central part, positioned substantially in the region lying below the boot, which is commonly referred to as a "wax zone". In this wax zone, the bottom surface is covered with a friction coating or wax which ensures good transmission of the friction forces when the skier exerts a vertical thrust and deforms the ski so as to press the wax in the wax zone against the snow.

Between these thrust phases, only the parts of the bottom surface lying to the front and rear of the wax zone are in contact with the snow, which makes it possible to exploit the gliding characteristics imparted by the gliding wax that covers them.

It will therefore be understood that the curvature imparted to the bottom surface is a very important parameter for optimizing the performance. It is thus essential for this curvature or flexure to be maintained, for example in order to prevent the friction wax in the wax zone from coming in contact with the snow during the gliding phases, if the skier's weight should be more than that for which the mechanical structure of the ski was designed.

It will also be understood that the thrust exerted by the skier may last for different lengths of time depending on whether the skier is stronger or weaker. There is thus a need to adapt the deformation capacity of the ski to the skiing style and technique employed, as well as to the skier's physique.

SUMMARY OF THE INVENTION

The invention therefore relates to a crosscountry ski, the lower face of which is curved to form a wax zone positioned substantially in the region lying below the user's boot.

According to the invention, this ski is one wherein its upper face has at least one recess, this or these recesses holding a rigid longitudinal bar extending from the rear of the wax zone to the front of this zone. One of the ends of each bar abuts on an element which is fixed relative to the ski, while complementary means interacting with the ends of each bar are provided in order to adjustably compress each of the bars.

In other words, the ski incorporates means for adjusting the stiffness and therefore the curvature of the ski under a variable load. It is thus possible to safeguard against a risk of contact between the wax zone and the snow, particularly when the skier is pressing down on both skis while he or she performs the alternate step technique.

When it is necessary to maintain a given curvature for a higher load, the bar or bars are thus put into a state of greater compression so as to sustain larger forces.

In practice, a wide variety of architectural means may be employed in order to achieve this compression.

It will firstly be noted that the complementary means for compressing said bars may act jointly on the two bars, or on each of the bars independently.

According to an alternative embodiment, the complementary means for compressing said bars may have an element which is screwed parallel to the bars, and which interacts with the end of the bar or bars.

The compression may also be obtained by means of a mechanism which has an articulated linkage, the ends of which interact with the free ends of the bar, the articulation point of the linkage being itself fixed relative to the ski.

In another alternative embodiment, the compression may be obtained by a mechanism which includes an eccentric cam interacting with the ends of the bars. This mechanism may be replaced by another mechanism which has sloping faces, the slope of which is not perpendicular to the direction of said bars and which interact with complementary surfaces integral with said bars. These complementary faces may be the ends of the bars themselves, or alternatively elements attached to the bar ends.

In general, the use of a simple tool such as a screwdriver makes it easy to adjust the compression of the bars.

In other alternative embodiments, the compression means may have a set of wedges with different sizes, one of which is interposed between a fixed point of the ski and the end of the bars. In other words, in this case the compression of each bar is adjusted by installing a wedge of suitable size.

The shape of the various bars and the recesses holding them makes it possible to fit a boot binding plate which covers the bars. This plate preferably has a protruding region under its lower face, this protruding region coming in contact with the upper face of the board between the bars.

In practice, the elements lying at the ends of the characteristic bars may interact with the component or components of the binding for fastening the boot on the ski. The term binding component is intended to mean either the device for attaching the toe of the boot or an element for guiding the rear part of the boot, which has ribs and/or grooves interacting with the sole of the boot.

The fixed element forming an abutment for the characteristic bars may thus be used to support a component of the binding. It may also be the complementary means for compressing the bars which are used to support the binding component.

Preferably, the fixed element for the complementary means may in practice be designed as a slideway for longitudinally adjusting the position of the binding component.

As a variant, one of the components of the binding may be fitted so that it can slide on the longitudinal bar, with a view to adjusting its longitudinal position.

BRIEF DESCRIPTION OF THE FIGURES

The way in which the invention may be embodied, and the advantages which result from this, will become more readily apparent from the following description of the embodiments with reference to the appended schematic figures, in which.

EMBODIMENTS OF THE INVENTION

As mentioned above, the invention relates to a crosscountry ski equipped with means for adjusting its stiffness, and therefore its flexion.

Figure 1:
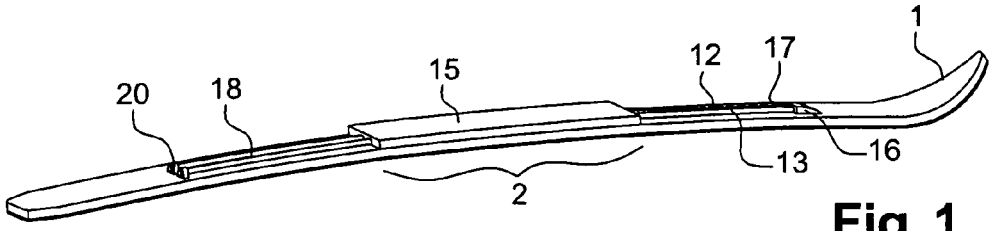
FIG. 1 is a schematic perspective view of a ski according to the invention.

More precisely, and as illustrated in FIG. 1, a crosscountry ski (1) has a region (2) referred to as a "wax zone" in its central region, as is known. The bottom of this wax zone (2) is coated with a layer of friction wax, and therefore it does not come in contact with the snow during the gliding phases but only during the thrust phases. This wax zone extends slightly to the front and rear of the region in which the boot is fitted. In front of and behind this wax zone (2), the bottom surface (3) has gliding regions (4) coated with a different type of wax which assists gliding.

According to the invention, the ski has one or more recesses (10) formed through its upper face (11) and constituting channels having walls to hold and constrain deformation of longitudinal bars (12, 13). The number of these recesses may vary, and is selected according to the extra stiffness which is intended to be imparted to the ski.

There are preferably two of these recesses, particularly for reasons of mechanical stability and also of space, that is to say so as to be able to fit the binding plate.

Figure 2:
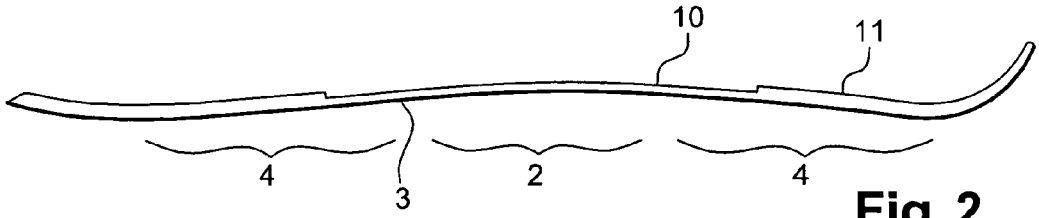
FIG. 2 is a view in longitudinal section along a characteristic recess.
Figure 3:
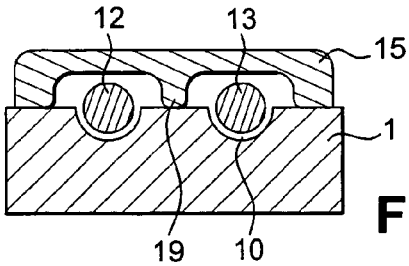
FIG. 3 is a cross section of the ski level with the wax zone.

Thus, as illustrated in FIG. 2, the recesses or channels extend over a length of the order of one meter. In the version illustrated, these channels (10) have a depth corresponding substantially to half the thickness of the bars (12, 13) which it holds, although this depth may be adapted in particular to the size of the bars.

In the version illustrated, these bars (12, 13) have a cylindrical cross section, but other variants may be envisaged without departing from the scope of the invention. These bars may be solid or hollow, depending on the material of which they are made, so long as they have a sufficient stiffness.

These bars are held inside the characteristic recesses, at the front, level with an abutment (16) which may preferably have two cavities into which the front ends (17) of the bars are inserted. At the central level, the bars are held inside the characteristic channels (10) by the binding plate (15).

Figure 4:
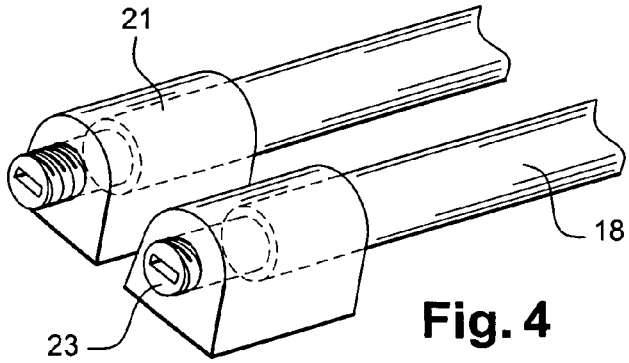
FIG. 4 is a schematic detailed perspective view of an embodiment of the means for adjusting the compression of the characteristic bars.

At the rear level, the ends (18) of the bars are held by guide means (20) which, according to the invention, also compress the bars. Many variants may be envisaged with a view to obtaining this compression, in particular the one illustrated in FIG. 4 which has tubular devises (21) holding the rear ends of the bars. These ends (18) are screw-threaded in order to interact with a screw thread made inside the devises (21). A screwing slot (23) allows the end (18) to be moved relative to the devises (21) and therefore relative to the ski. In this case, the compression of each bar is adjusted independently.

Figure 5:
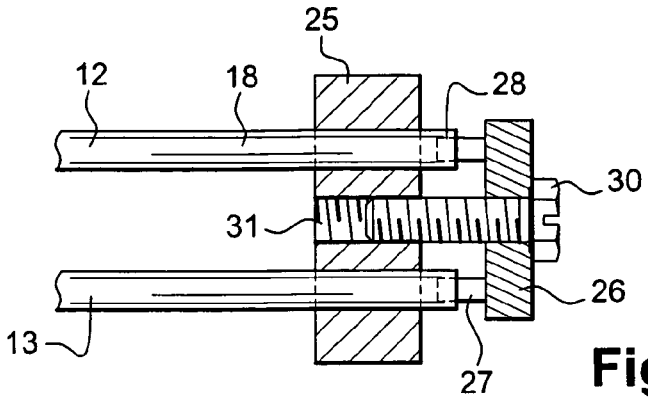
FIGS. 5, 6 and 7 are views of alternative embodiments of the means for adjusting the compression.

A variant as illustrated in FIG. 5 allows simultaneous adjustment of the compression. In this case, the ends (18) of the bars and the clevis (25) are smooth. The two bars (12, 13) are coupled by a connecting piece (26) having lugs (27) which are inserted into a cavity (28) formed at the end of the bars, or into the bar itself if it is tubular. This connecting piece (26) has a screw (30) engaging in the central part (31) of the clevis (25), so that the two bars (12, 13) can be compressed simultaneously by screwing.

Other variants may be envisaged, in particular using a system of the articulated linkage type.

Figure 6:
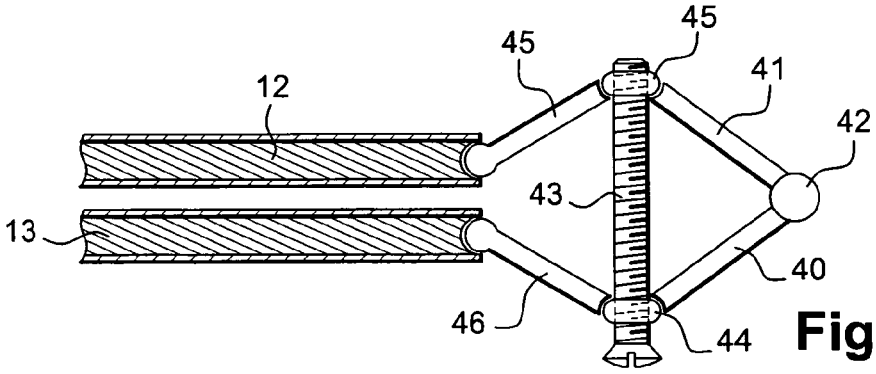

For instance, the mechanism illustrated in FIG. 6 has two branches (40, 41) articulated relative to each other and relative to a fixed point (42) on the ski. The angle between these two bars (40, 41) can be adjusted, for example by means of a screw (43).

The screwing action alters the distance in the longitudinal direction of the ski, between the articulation point (42) and the ends (44, 45) of the branches. These branches are extended by articulated rods (46, 47) whose pivoted ends interact with the ends of the bars (12, 13).

Figure 7:
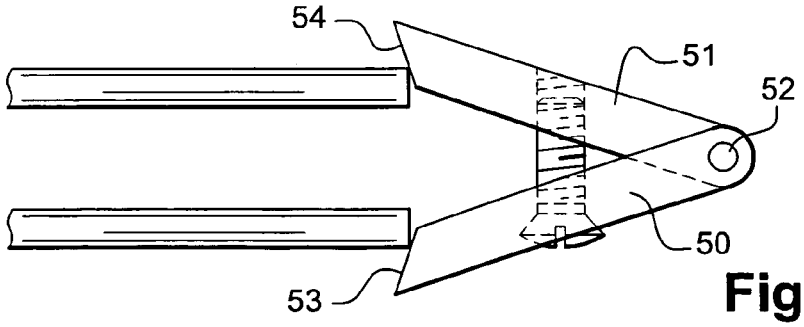

An alternative embodiment is illustrated in FIG. 7, in which the branches of the articulated linkage (50, 51) have inclined surfaces (53) coming in contact with the ends of the bars (12, 13). Movement of the two branches (50, 51) leads to displacement of the point of contact (54) between these sloping surfaces (53) and the bars, and therefore to adjustable compression of the bars.

Figure 8:
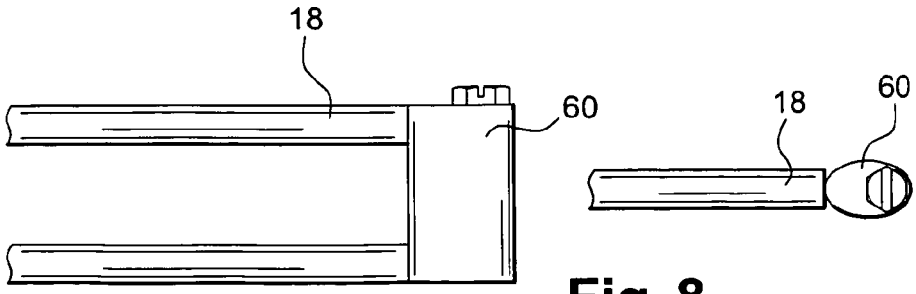
FIG. 8 is a side view of another embodiment of the compression means.

Other alternatives may be embodied, and in particular the one as illustrated in FIG. 8 in which the rear end (18) of the bar (12) comes in contact with an eccentric cam (60). This eccentric cam (60) can pivot about an axis which is fixed relative to the ski, so that its rotation pushes the end of the bar forward and therefore causes compression of the bar.

Figure 9:
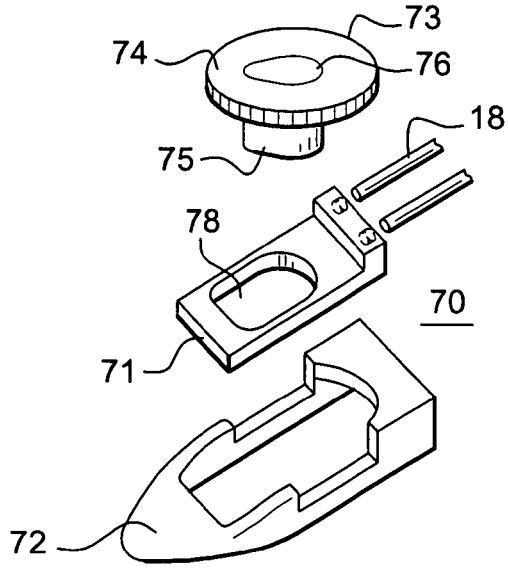
FIG. 9 is an exploded view of an alternative embodiment of the compression means.

A similar system may be implemented as illustrated in FIG. 9. Such a mechanism (70) includes a piece (71) into which the rear ends (18) of the bars are plugged. This intermediate piece (71) is covered with a cap (72) fixed relative to the ski, in which a knurled wheel (73) can be moved. The upper part (74) of the knurled wheel (73) is circular, while the lower part (75) of this knurled wheel is off-center relative to the axis of rotation (76) of the knurled wheel relative to the cap (72). This part (75) forms an eccentric cam which interacts with a cavity (78) formed in the intermediate piece, so that rotation of the knurled wheel (73) leads to displacement of the intermediate piece (71) in the longitudinal direction, and therefore to compression of the bars.

Figure 10:
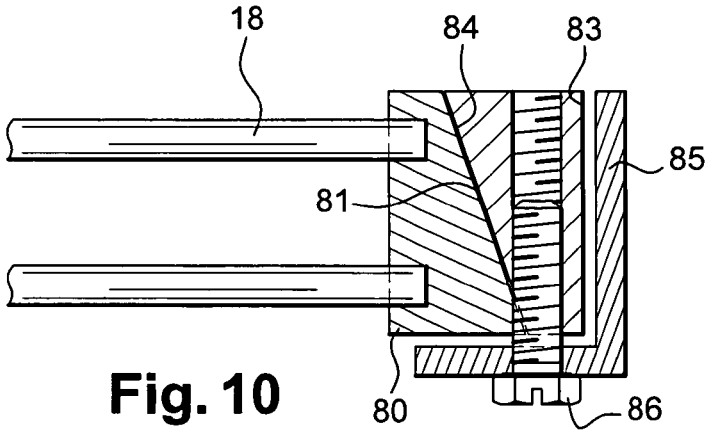
FIG. 10 is a plan view of another alternative embodiment of the compression means.

A similar result can be obtained with beveled wedges, as illustrated in FIG. 10. In this case, the rear ends (18) of the bars receive a first wedge (80) whose rear face (81) is not perpendicular to the axis of the ski. This first wedge (80) interacts with a second wedge (83) having a front face (84) which is also inclined.

This wedge (83) is able to move transversely relative to the ski by means of a mounting piece (85) joined to the upper face of the ski. Action on the screw (86) allows transverse displacement of the wedge (83), and therefore the exertion of longitudinal forces on the first wedge (80).

Figure 11:
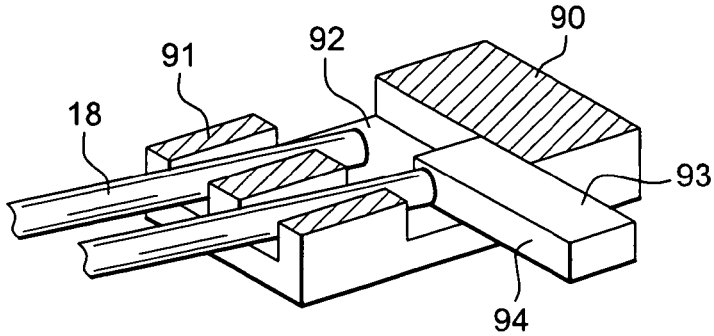
FIG. 11 is a schematic perspective view of another embodiment of the compression means.

Other alternatives may be employed, and in particular the one as illustrated in FIG. 11 in which the rear ends (18) of the bars are each placed inside a cavity (91) in a piece (90) which is fixed relative to the ski. This piece (90) has a lateral opening (92). This opening can hold wedges (93) of variable size. The front face (94) of these wedges (93) comes in contact with the rear ends of the bars (18), therefore putting them in a state of compression which can hence be varied according to the width of the wedge (93). These wedges (93) are fitted while manually or mechanically curving the ski. Means may be provided in order to prevent the wedge from accidentally escaping from the ski in the event that the ski becomes very curved. Reinforcements may also be provided to prevent the end (18) of the bars (12, 13) from puncturing the wedges.

Figure 12:
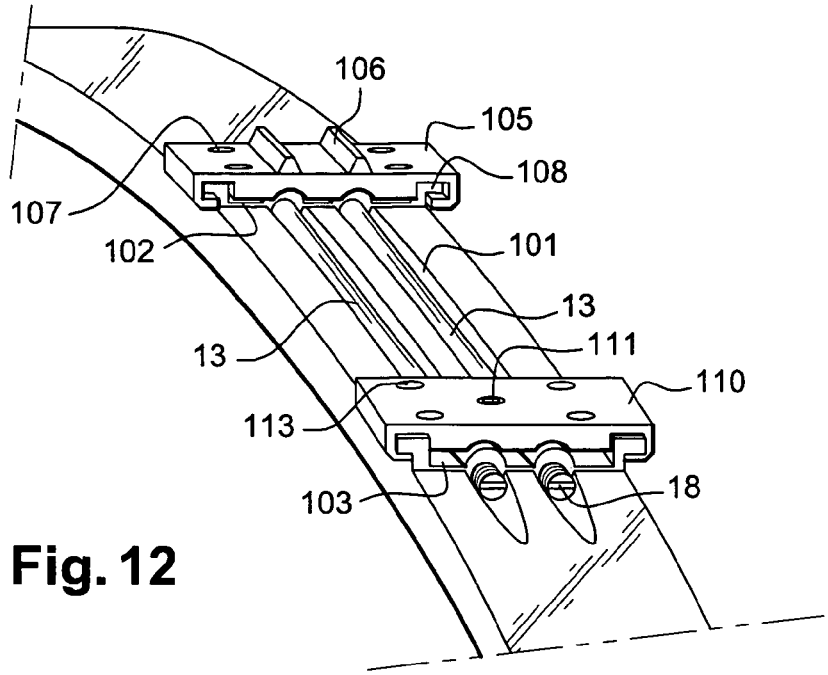
FIG. 12 is a schematic perspective view of the central portion of a ski according to an alternative embodiment, in which the binding interacts with the elements for compressing the characteristic bars.

In the variant illustrated in FIG. 12, the bars (13) are mounted in two recesses (101) and are compressed between a first fixed element (102), on the one hand, and a second fixed element (103) into which the ends (18) of the bars are screwed. More specifically, on its upper face, the first fixed element (102) forming an abutment receives the rear binding component (105) which includes ribs (106) for interacting with the sole of the boot. This rear component (105) may be formed in a monobloc fashion, as schematically illustrated, or alternatively it may consist of a plurality of pieces assembled together, one directly interacting with the first fixed element (102) and the other containing the guide ribs (106). In the version illustrated, the rear component (105) interacts with the fixed element (102) via a slideway mechanism (108) allowing it to be adjusted longitudinally so as to match the user's foot size. Of course, Different types of slideways may be adopted without departing from the scope of the invention. The rear component (105) may be immobilized on the fixed element (102) by locking means which are accessible through the openings (107).

In the same spirit, the front fixed element (103) is also designed in the form of a slideway for adjusting the position of the base (110) of the binding component which contains the mechanism (not shown) for engaging the front end of the boot. The adjustment position may be indexed using means which pass through the opening (111). The upper part (not shown) containing the engagement mechanism is fixed on the base (110) level with the internal screw threads (113).

Figure 13:
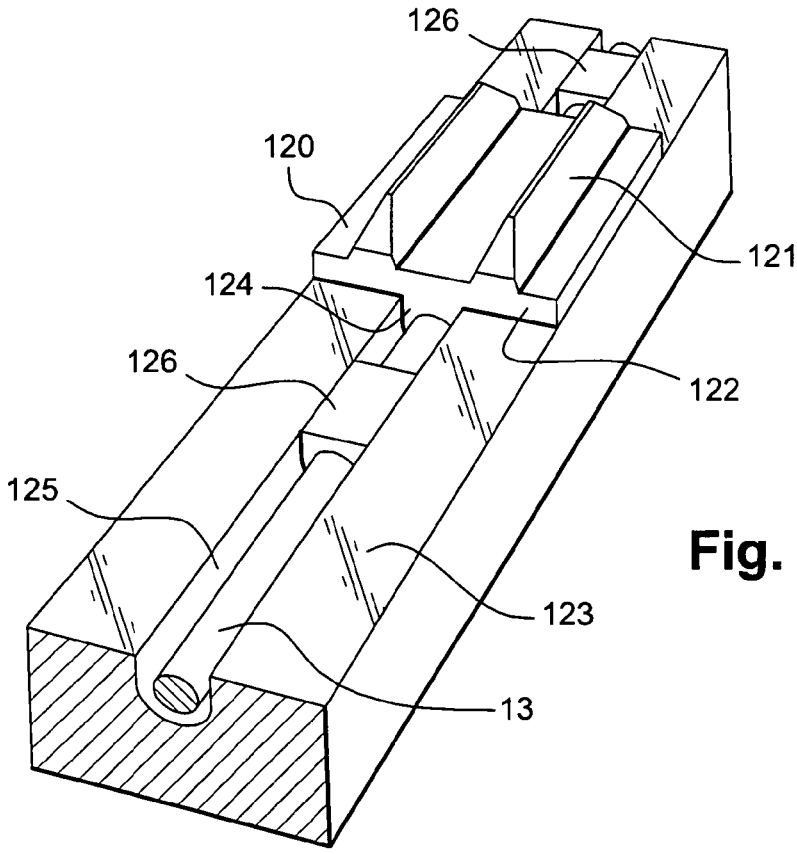
FIG. 13 is a schematic perspective view of the central portion of a ski, which includes a binding component according to an alternative embodiment.

In the variant illustrated in FIG. 13, the rear binding component (120) containing the ribs (121) is mounted with a portion (122) which rests directly on the upper face (123) of the ski, and a portion (124) which extends into the recess (125) holding the characteristic bar (13). This bar is represented only over a part of its length, between holding struts (126). The bar (13) passes through the portion (124) present in the recess (125), so that it secures the rear component (121) on the ski. A mechanical indexing mechanism (not shown) may be provided in order to prevent any longitudinal displacement of the rear binding component (121), and possibly to allow adjustment of its longitudinal position.

The invention is of course not limited just to the embodiments which have been illustrated, in particular as regards locating the adjustment means at the rear of the ski. This adjustment means may naturally be placed at the front of the board, for instance, without departing from the scope of the invention. The above description shows that the invention makes it easy to adjust the stiffness of the ski in order to maintain an optimized curvature in relation to the skier's weight and his or her style. The risks of the wax zone coming in contact with the snow during the gliding phases are thus greatly reduced.

The invention claimed is:

1. A crosscountry ski (1), wherein the lower face (3) of which is curved to form a wax zone (2) positioned substantially in the region lying below the user's boot, wherein at least one longitudinal recess (10) is provided extending down through the upper face (11) and along the length of the ski, and wherein the at least one longitudinal recess (10) holds a rigid longitudinal bar (12, 13) extending from the rear of the wax zone (2) to the front of said zone, with a first end (17) of the bar (12, 13) abutting (4) on an element (16) which is fixed relative to the ski, while complementary means (20) interacting with a second end (18) of the bar (12, 13) are provided in order to adjustably compress said bar (12, 13)

wherein the first end and the second end of the bar is respectively fixed to the ski through the element (16) and the complementary means, and wherein the bar is constrained from deforming by walls of the at least one longitudinal recess.

2. The crosscountry ski as claimed in claim 1, wherein the fixed element (102) is used to support a component (105) of the binding for fastening the boot on the ski.

3. The crosscountry ski as claimed in claim 2, wherein the fixed element (102) or the complementary means (103) are designed as a slideway for longitudinally adjusting the position of the component (105, 110) of the binding for fastening the boot on the ski.

4. The crosscountry ski as claimed in claim 1, wherein the complementary means (103) are used to support a component (110) of the binding for fastening the boot on the ski.

5. The crosscountry ski as claimed in claim 4, wherein the fixed element (102) or the complementary means (103) are designed as a slideway for longitudinally adjusting the position of the component (105, 110) of the binding for fastening the boot on the ski.

6. The crosscountry ski as claimed in claim 1, wherein a component (121) of the binding for fastening the boot on the ski can slide on the longitudinal bar (13).

7. The crosscountry ski as claimed in claim 1, wherein the ski has two of said at least one longitudinal recesses is two each holding said longitudinal bar.

8. The crosscountry ski as claimed in claim 7, wherein the complementary means (25-31) for compressing said bars act jointly on the two bars (12, 13).

9. The crosscountry ski as claimed in claim 7, wherein the complementary means for compressing said bars each have an element (23) which is screwed parallel to the bars (12, 13) and interacts with the respective end of the bars.

10. The crosscountry ski as claimed in claim 7, wherein the complementary means for compressing said bars have an articulated linkage (40, 41; 50, 51) the free ends (44, 45; 43-54) of which interact with the ends (18) of said bars.

11. The crosscountry ski as claimed in claim 7, wherein the complementary means for pressing said bars have an eccentric cam (60) interacting with the ends of said bars.

12. The crosscountry ski as claimed in claim 7, wherein the complementary means for compressing said bars have sloping faces (84) with a slope not perpendicular to the direction of said bars, which interact with a complementary surface (81) integral with said bars.

13. The crosscountry ski as claimed in claim 7, wherein the complementary means for compressing said bars have a set of wedges (93) with different sizes, one of which is interposed between a fixed point of the ski and the ends of said bars.

14. The crosscountry ski as claimed in claim 7, wherein it has a boot binding plate (15) covering said bars (12, 13).

15. The crosscountry ski as claimed in claim 14, wherein said plate has a protruding region (19) under its lower face, which comes in contact with the upper face of the board between said bars (12, 13).

16. The crosscountry ski as claimed in claim 1, wherein the longitudinal bar is spaced apart from the walls of the at least one longitudinal recess.

17. The crosscountry ski as claimed in claim 1, wherein the at least one longitudinal recess has a cross-section and depth substantially corresponding to half the thickness of the longitudinal bar.

18. The crosscountry ski as claimed in claim 1, wherein the at least one longitudinal recess (10) is formed as a unit with and in the ski.

19. The crosscountry ski as claimed in claim 1, wherein cross-sections through the at least one longitudinal recess and the bar are respectively concave and circular.

20. A crosscountry ski (1), the lower face (3) of which is curved to form a wax zone (2) positioned substantially in the region lying below the user's boot, wherein its upper face (11) has recesses (10), and wherein each of the recesses (10) holds a rigid longitudinal bar (12, 13) extending from the rear of the wax zone (2) to the front of said zone, with a first end (17) of each bar (12, 13) abutting (4) on an element (16) which is fixed relative to the ski, while complementary means (20) interacting with a second end (18) of each bar (12, 13) are provided in order to adjustably compress said bars (12, 13), wherein it has a boot binding plate (15) covering said bars (12, 13) , and wherein said plate has a protruding region (19) under its lower face, which comes in contact with the upper face of the board between said bars (12, 13).

* * * * *